US007454153B2

(12) United States Patent
Boness et al.

(10) Patent No.: US 7,454,153 B2
(45) Date of Patent: Nov. 18, 2008

(54) CLEANING OF CONTAMINATION IN A PRINTER AS A FUNCTION OF A REGISTER ERROR

(75) Inventors: Jan Dirk Boness, Bad Bramstedt (DE); Ingo Klaus Michael Dreher, Kiel (DE); Stefan Schrader, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/576,805

(22) PCT Filed: Oct. 20, 2004

(86) PCT No.: PCT/US2004/034824

§ 371 (c)(1),
(2), (4) Date: Jan. 16, 2007

(87) PCT Pub. No.: WO2005/047986

PCT Pub. Date: May 26, 2005

(65) Prior Publication Data

US 2007/0122178 A1 May 31, 2007

(30) Foreign Application Priority Data

Nov. 4, 2003 (DE) ..... 103 51 420

(51) Int. Cl.
*G03G 15/01* (2006.01)
*G03G 15/16* (2006.01)
*G03G 21/00* (2006.01)

(52) U.S. Cl. ..... 399/98; 399/301; 399/101

(58) Field of Classification Search ..... 399/98, 399/101, 301

See application file for complete search history.

(56) References Cited

U.S. PATENT DOCUMENTS

| | | | |
|---|---|---|---|
| 5,313,252 | A | 5/1994 | Castelli et al. |
| 5,523,830 | A | 6/1996 | Tamura et al. |
| 5,828,926 | A | 10/1998 | Iwata et al. |
| 5,923,923 | A | 7/1999 | Kobayashi et al. |

FOREIGN PATENT DOCUMENTS

| | | | |
|---|---|---|---|
| JP | 05011525 | | 1/1993 |
| JP | 08123238 | | 5/1996 |
| JP | 2003195604 A | * | 7/2003 |
| JP | 2003241470 A | * | 8/2003 |

OTHER PUBLICATIONS

Translation of JP 05-011525 A.*

* cited by examiner

*Primary Examiner*—Ryan Gleitz
(74) *Attorney, Agent, or Firm*—Lawrence P. Kessler

(57) ABSTRACT

Cleaning of contamination in a printer, especially contamination by the use of a fixing aid, in which the contamination is determined by evaluating the register of a print of the printing machine. In the case that the register error is larger than a given amount, a cleaning run is performed. A control device is provided for evaluation of the register for determining contamination of the printer, especially by a fixing aid.

4 Claims, 2 Drawing Sheets

CLEANING OF CONTAMINATION IN A PRINTER AS A FUNCTION OF A REGISTER ERROR

FIELD OF THE INVENTION

The invention concerns determining contamination by a fixing aid in a printer by evaluating register of a print.

BACKGROUND OF THE INVENTION

Fixation of a toner on a print is achieved, among other things, by rolling a heated fixing roller with pressure on the print and reliably joining the toner in this way to the print. In order to achieve reliable separation of the fixing roller from the print, a fixing oil subsequently also referred to in general as a fixing aid, is often applied to the fixing roller. A shortcoming is that the fixing oil is taken up in an undesired manner by the printer, and covers parts of the printer. Because of this, the printer result is also adversely affected, if the fixing oil reaches the printed image. Cleaning passes of the printer, to free it of the fixing aid, are therefore prescribed in the prior art. However, it is unspecified when and whether a cleaning pass is necessary.

SUMMARY OF THE INVENTION

One task of the invention is to guarantee the fixing of toner on a print. Another task of the invention is to reduce contamination of the printer by the fixing oil or a fixing aid. Another task of the invention is to guarantee the printing quality of the printer.

According to the invention, a method is presented for determining contamination in the printer, by a fixing aid, in which the contamination is determined for the first time by evaluation of the register of a print of the printer. A printer is also proposed, especially for execution of the method according to the invention, with a control device for evaluation of the register for determining contamination of the printer, by a fixing aid. In this manner, contamination of the printer is avoided and a persistently high printing quality is guaranteed. Contamination of the printer is established without inspection of the contaminated parts of the printer and without checking the printed image. Contamination of the printer is merely determined from already available data with reference to the register.

In a preferred variant of the invention, a sensor records marks of the print, and a register error is determined from the recorded marks. Determination of contamination of the printer is automated by this sensor error. Sensors are also used, which are already present to determine the register and/or register holding in the printer.

At a specific size of the register error, a cleaning pass of the printer is started. The printing process is facilitated in this way; the running times of the printer are increased and the operating expense are reduced, since contamination in this variant is not determined by the user of the printer.

In multiple colors, the register error of any color is determined, during which the method according to the invention for determining contamination of the printer is improved since, with each individual register error of each individual color, the contamination of the printer can be determined; and a combination of individual register errors increases the reliability of the measurements.

BRIEF DESCRIPTION OF THE DRAWINGS

Variants of the invention are described below in detail with reference to the figures.

DETAILED DESCRIPTION OF THE INVENTION

Figure 1:
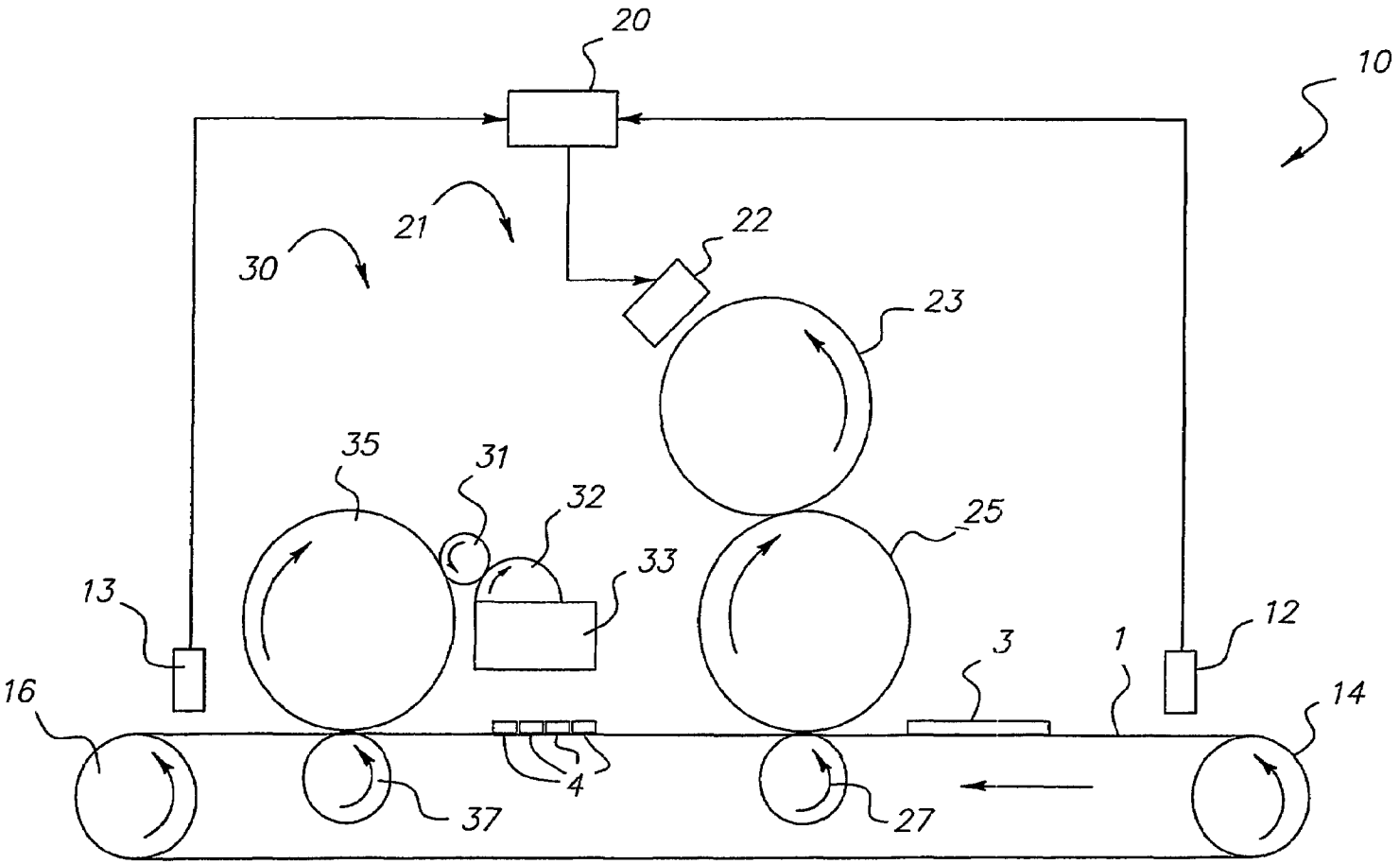
FIG. 1 shows a schematic side view of part of a printer with sensors to record the register and a fixing device to fix the toner on the print.

FIG. 1 shows a schematic side view of part of a printer 10 with an endless conveyor belt 1, which is tightened around a first deflection roller 14 and a second deflection roller 16, which drive the conveyor belt 1. The first deflection roller 14, the second deflection roller 16, and the conveyor belt 1 revolve in the direction shown by the respective arrows. A printing module 21 that applies a specific color onto a print 3, conveyed by a conveyor belt 1, is arranged above the conveyor belt 1. The printing module 21 or printing mechanism includes an imaging device 22 to transfer an electrostatic image to an imaging cylinder 23 and an intermediate cylinder 25 to transfer an image from the imaging cylinder 23 to the print 3. Marks 4 to adjust the register are also printed by the imaging device 22 on conveyor belt 1 during a calibration pass of the printer 10.

The imaging device 22 includes components necessary for the transfer of an image, essentially a charging device to apply an electrical charge to the surface of the imaging cylinder 23, a controlled light source to generate a latent electrical image on the electrically charged surface, and an inking device to apply toner to the electrically charged sites, during which a visible image is formed on the surface of the imaging cylinder 23. The toner is transferred from the imaging cylinder 23 to the intermediate cylinder 25 and from it to the print 3, so that finally an image formed from the toner is present on print 3. A first counter pressure roller 27 on the opposite side of conveyor belt 1, which rolls in the direction of the arrow on conveyor belt 3, furnishes a counterforce to intermediate cylinder 25. While one printing module 21 or printing mechanism is shown in FIG. 1, additional printing modules can also be present, especially an additional printing module 21 for each color used in the printer 10.

Behind printing module 21, viewed in the transport direction, a fixing device 30 is arranged, which serves to reliably fix the printed image applied by the printing module 21 or printing modules onto the print 3 in which the toner, which forms the printing image, meshes with the print 3. The fixing device 30 includes a heated fixing roller 35, which rolls in the direction of the arrow on print 3 and applies pressure and heat to the print 3 with toner. On the opposite side of transport conveyor belt 3, a second counter pressure roller 37 is arranged, which provides a force opposite the fixing roller 35 and rolls in the opposite direction of rotation on the bottom of conveyor belt 3.

A delivery device 33, filled with a fixing aid, is arranged in fixing device 30 in association with fixing roller 35. A roller, subsequently also a metering roller 32, rotates in the delivery device 33 on a non-woven fabric and absorbs a certain amount of fixing aid, usually fixing oil. An additional roller rolls on metering roller 32, subsequently donor roller 31, which absorbs the fixing aid from the metering roller 32 and conveys it to the fixing roller 35 by rolling on it. The fixing aid serves to facilitate release of the fixing roller 35 from the print 3. A drawback during the use of the fixing aid is that it is transported in an undesired manner by the printer 10 and deposited on parts of the printer 10. The printed image on the print 3 thus can be adversely affected by the fixing aid, for example, oil spots can form on the printed image, or the printed image can exhibit streaks.

A first sensor 12 at the beginning of the conveyor belt 1 detects the front edge of the print 3 during the printing process, in this case a sheet of paper, and transmits the information to a control device 20. Based on the information relative to the front edge of print 3 and other available data, the control device 20 sends a signal to the imaging device 22, which then initiates the imaging process, as described. In this manner, the printed image is applied to the desired site on the print 3 or, in the case of marks 4, to the conveyor belt 1. During a calibration pass of the printer to set the precise position of the printed image, the marks 4 are usually printed on the conveyor belt 1. A second sensor 13 behind the printing modules 21 detects the mark 4 and transmits corresponding signals to the control device 20. Usually, one mark 4 is printed on the conveyor belt 1 from each printing module 21, for each color that is printed by a printing module 21. In the control device 20 of the printer, each mark 4 is evaluated to assure the mark is situated in an error-free position, i.e., whether the register is correct or whether the marks 4 have a position deviation and a register error is present.

Figure 2:
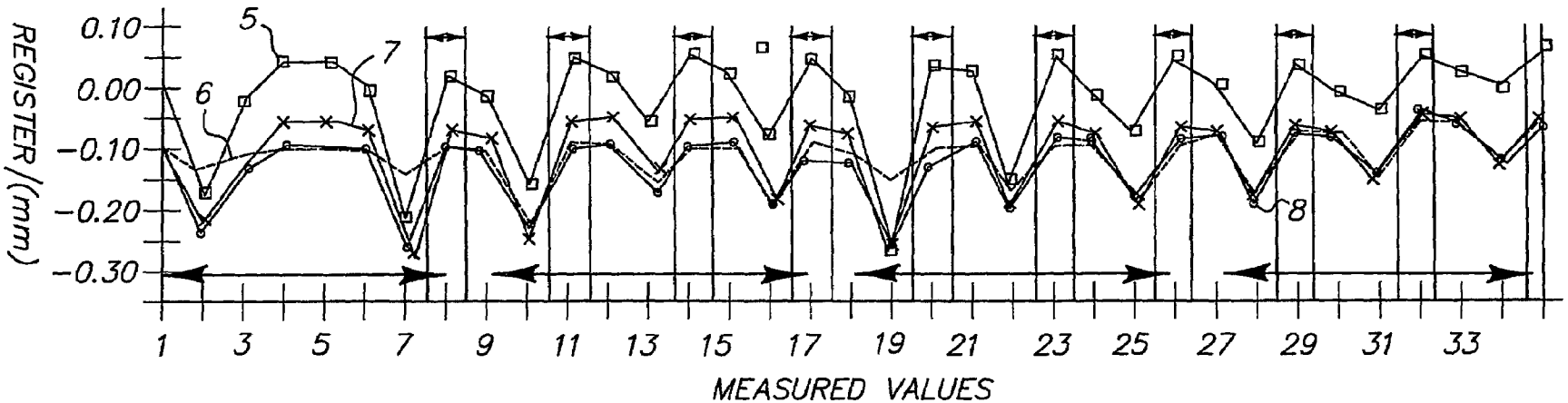
FIG. 2 shows functional trends of register errors as a function of measured values of the register, in order to show the relation between a register error and fixing aid contamination of the printer.

FIG. 2 shows four functional trends of the register errors of four different colors, these being the colors yellow, magenta, cyan, and black in the example. The numbers of the measurements of the register are plotted on the abscissa, and 86 measured values for each color are entered. The registers (in millimeters) around a value of zero are plotted on the ordinate, which marks an error-free register. The deviations of the register are shown, i.e., the register errors, which are deviations in the positions of the printed image from their error-free position at the zero point.

For example, here a register error is described in the transport direction, the so-called in "track error". This means the depicted register error is characterized by position deviations of marks 4 in the transport direction of conveyor belt 1, and the marks 4 are situated in front of or behind the error-free position on the conveyor belt 1 in the direction of the arrow. The register error is preferably recorded by means of marks 4, especially during a calibration run of the printer, which is conducted before the printing process, and serves essentially to adjust the correct register. Each curve trend in FIG. 2 is provided with a reference number, the curve trend being for black with the first curve 5, for cyan with the second curve 6, for yellow with the third curve 7, and for magenta with the fourth curve 8.

It is apparent in FIG. 2 that the values of curves 5, 6, 7, and 8 of the register deviate in different ways from the zero value, both in the positive and negative range. The long, double-sided arrows on the bottom of the coordinate system each denote a group of measured values that consist of eight measured values. The small double-sided arrows on the top of the coordinate system denote measured values that are recorded after running a cleaning pass of the printer 10, as described below.

It is readily apparent that all four curves 5, 6, 7, 8 have qualitatively similar trends and tend toward register errors in the direction of negative values. The measured values of 4 to 7 are considered, in which trend the register error for black, the first curve 5, drops from about 0.05 mm to −0.21 mm. For yellow, the third curve 7, the corresponding measured values drop from about −0.05 mm to about −0.27 mm. Especially the measured values for black, which is printed by the appropriate printing module 21, have a strong dependence on oil entry, and contamination of the printer 10 with fixing aid, especially fixing oil. In an uncontaminated printer 10, the measured values for black lie at about 0.05 mm, whereas in a printer 10, which is contaminated by the fixing aid, they are at −0.05 mm and less.

The described curve trends can vary during different measurements and external influences. Curves 5, 6, 7, and 8 then do not show a constant trend, as shown in FIG. 2. The register errors are recorded in the control device 20 of the printer 10 and evaluated. In the prior art, these are used to appropriately calibrate printer 10, in order to apply the marks 4 and, during the subsequent printing process, the printed image in the transport direction in the error-free position, i.e., to eliminate the "in track error" of the register. In the present application, it is determined, based on the measured values in the control device, that contamination of the printer 10 with fixing aid from the fixing roller 35 is present. The control device 20 recognizes this state by the fact that subsequent values of the function trends diminish and, in particular, the value falls short of a certain tolerance range, for example, the seventh value of curve 5, 6, 7, 8, and the values with the numbering on the abscissa being 10, 13, 16, 19, 22, 25, 28, 31, and 34.

If a conspicuously sharply diminishing measured value is present, which falls below a certain value stored in the control device 20, this is an indication that contamination of the printer 10 with fixing aid from the fixing roller 35 is present. The control device 20 of the printer 10 in this case recognizes that a cleaning pass of the printer 10 is necessary. This is started by the control device 20 during which, for example, three hundred sheets of paper in the DIN A3+ format are supplied by the printer. The sheets of print 3 are covered with about 30% dry toner in each toner color, so that the printer 10 is appropriate freed of fixing aid. The next measured value after the cleaning run, and according to the minimum of the function trends of curves 5, 6, 7, and 8 according to FIG. 2, shows a register error around the zero value, for example, each of the measured values 8 for all curves 5, 6, 7, and 8.

The measured values for the registers that are recorded after the cleaning pass of the printer are situated within the vertical lines according to FIG. 2, which are marked by the double-sided arrows in the upper region of the coordinate system, and these are the measured values: 8, 11, 14, 17, 20, 23, 26, 29, 32, and 35. The individual measured values are recorded at distinct time intervals, and significant printer running times lie between the individual values. The measured values are therefore, not recorded immediately after each other by the second sensor 13.

In printer 10, as already described, necessary controls of contamination by the fixing aid are regularly saved. The printer running times are increased and the frequency of maintenance is reduced. A cleaning pass of the printer 10 is only conducted when contamination makes this necessary. The control device 20 executes the cleaning pass automatically when measured values are determined as described, with operation by a person not being necessary in this case. The cleaning pass can be conducted during a running-print order or calibration run, in which the printer order or calibration is continued after the cleaning pass.

The invention claimed is:

1. Method for determining contamination in a printer (10), from a fixing aid, said method comprising the steps of:

recording detecting marks (4) on a print conveyor belt (1) of a printer (10);

detecting the detecting marks (4)

determining a register error from the recorded detecting marks (4):

determining contamination from a fixing aid by evaluation of the above determined register error of a print; and after reaching a certain level of register error, effecting a cleaning run of the printer (10).

2. Method of determining contamination from a fixing aid according to claim 1, wherein in multicolor printing, the register error of each color is determined.

3. Method of determining contamination from a fixing aid according to claim 1, wherein in contamination of the printer (10) is determined by evaluation of the register error in the transport direction of conveyor belt (1) of printer (10).

4. Printer comprising:

a device for recording detecting marks (4) on a conveyor belt (1) transported through a printer (10);

a sensor (13) for detecting the detecting marks (4):

a control device (20) for controlling the printer (10), said control device determining a register error of a print from the recorded detecting marks (4), and determining contamination of the printer (10) from a fixing aid by evaluation of the register error; and after reaching a certain level of register error, effecting a cleaning run of the conveyor belt (1) of the printer (10).

* * * * *